US006422154B1

(12) United States Patent
Long

(10) Patent No.: US 6,422,154 B1
(45) Date of Patent: Jul. 23, 2002

(54) THREE-PIECE RAILWAY TRUCK FRAME HAVING A SELECTIVELY REMOVABLE BOLSTER

(75) Inventor: Jack R. Long, St. Charles, IL (US)

(73) Assignee: Meridian Rail Information Systems Corp., Lombard, IL (US)

( * ) Notice: Subject to any disclaimer, the term of this patent is extended or adjusted under 35 U.S.C. 154(b) by 0 days.

(21) Appl. No.: 09/504,317

(22) Filed: Feb. 14, 2000

(51) Int. Cl.[7] ..... B61F 5/00

(52) U.S. Cl. ..... 105/206.1; 105/182.1; 105/226

(58) Field of Search ..... 105/157.1, 182.1, 105/185, 193, 198.2, 198.3, 198.4, 198.5, 200, 202, 206.1, 207, 226, 230

(56) References Cited

U.S. PATENT DOCUMENTS

| | | | | | |
|---|---|---|---|---|---|
| 506,170 | A | | 10/1893 | Ettenger | |
| 625,925 | A | | 5/1899 | Cloud | |
| 1,133,203 | A | | 3/1915 | Van Kirk | |
| 1,757,765 | A | * | 5/1930 | Dreibuss et al. | 105/230 |
| 2,166,858 | A | * | 7/1939 | Bugatti | 105/193 |
| 3,338,183 | A | * | 8/1967 | Boissier | 105/202 |
| 3,411,458 | A | * | 11/1968 | Sinclair | 105/185 |
| 3,517,620 | A | * | 6/1970 | Weber | 105/193 |
| 3,654,870 | A | | 4/1972 | Wallace | |
| 3,654,871 | A | * | 4/1972 | Wallace | 105/226 |
| 3,937,153 | A | * | 2/1976 | Durocher | 105/193 |
| 4,491,075 | A | | 1/1985 | Neumann | |
| 5,417,163 | A | * | 5/1995 | Lienard | 105/198.7 |

* cited by examiner

*Primary Examiner*—Mark T. Le
(74) *Attorney, Agent, or Firm*—Lee, Mann, Smith, McWilliams, Sweeney & Ohlson

(57) ABSTRACT

A railway truck frame for a railway truck including a first side frame and a second side frame, each side frame having an inverted trapezoidal-shaped window including a first inclined side and a second inclined side. The truck frame also includes a bolster having a first end and a second end which extends transversely between the first and second side frames. Each end of the bolster includes a first inclined channel and an opposing second inclined channel. Each channel includes an exterior flange, a spaced apart interior flange, and a bearing surface located between the exterior and the interior flanges. Each inclined side of a window is adapted to be located in a respective first or second channel between the exterior flange and the interior flange of the channel and in engagement with the bearing surface of the channel. A locking device such as a jack is located in each window between the top of the end of the bolster and the top side of the window which selectively forces the end of the bolster downwardly into engagement with the side frame such that the end of the bolster is rigidly but removably connected to the side frame.

14 Claims, 2 Drawing Sheets

THREE-PIECE RAILWAY TRUCK FRAME HAVING A SELECTIVELY REMOVABLE BOLSTER

BACKGROUND OF THE INVENTION

The present invention is directed to a three-piece railway truck frame of "H" frame type construction having a bolster extending between first and second side frames, and in particular to a three-piece railway truck frame wherein the bolster may be selectively rigidly connected to and removed from each side frame.

Railway freight car trucks of "H" frame type construction typically include a truck frame having a pair of side frames that are spaced apart from, and parallel to, one another. The side frames are connected to one another by a transversely extending bolster. The prior railway truck frame was cast or fabricated from steel as a single unitary and integral member. Alternatively, the prior railway truck frame was constructed from three separate pieces, namely a bolster, a first side frame and a second side frame. In the three-piece version of the prior railway truck frame the connection between each bolster end and a side frame was made by mating machined cylindrical areas with one another and then welding each bolster end to a respective side frame, or by other joint structure welded together. The bolster was thereby, for practical purposes, permanently attached to the side frames. This procedure is expensive, labor intensive and makes disassembly or removal of the bolster from the side frames for conducting repairs virtually impossible without damaging the truck frame. The present invention overcomes these problems in the prior art.

SUMMARY OF THE INVENTION

A railway truck frame for a railway truck including a first side frame, a second side frame, a bolster, and a plurality of locking devices. The first and second side frames each include a window extending through the side frame. The window includes an inclined first side and an inclined second side which are arranged in a generally V-shaped manner such that the window is generally trapezoidal-shaped. The first and second inclined sides of each window include one or more generally planar bearing surfaces.

The bolster includes a first end and a second end. Each end of the bolster includes a first inclined channel having a first exterior flange, a first interior flange spaced apart from the first exterior flange and a bearing surface located between the first exterior flange and first interior flange. Each end of the bolster also includes a second inclined channel having a second exterior flange, a second interior flange spaced apart from the second exterior flange, and a second bearing surface located between the second exterior flange and second interior flange. The flanges and bearing surface of the first channel and the flanges and bearing surface of the second channel are located in a generally V-shaped arrangement with respect to one another. The first and second channels of the first end of the bolster are adapted to respectively receive the first side and second side of the window of the first side frame, such that the first side frame is located between the interior flanges and exterior flanges of first and second channels and such that the bearing surfaces of the first side and second side of the window are in engagement with the bearing surfaces of the first and second channels. The second end of the bolster is constructed in the same manner as the first end of the bolster and is adapted to engage the second side frame in the same manner as the first end of the bolster engages the first side.

One or more locking devices are located between the top of the first end of the bolster and a top side of the window in the first side frame. One or more locking devices are also located between the top of the second end of the bolster and the top side of the window of the second side frame. Each locking device comprises a jack having a first base member adapted to engage the top of the bolster and a second base member adapted to engage the top side of the window. The jack also includes first and second wedges which are located between the first and second base members. The first and second wedges are coupled to one another by a fastener that is adapted to selectively draw the wedges toward one another. The wedges thereby force the first and second base members apart from one another and force the end of the bolster into engagement with the first and second sides of the window of the side frame such that the end of the bolster is rigidly connected to the side frame. The locking devices can be selectively removed from the window of each side frame to permit the ends of the bolster to be selectively moved from the window of each side frame.

BRIEF DESCRIPTION OF THE DRAWING FIGURES

DETAILED DESCRIPTION OF THE PREFERRED EMBODIMENT

Figure 1:
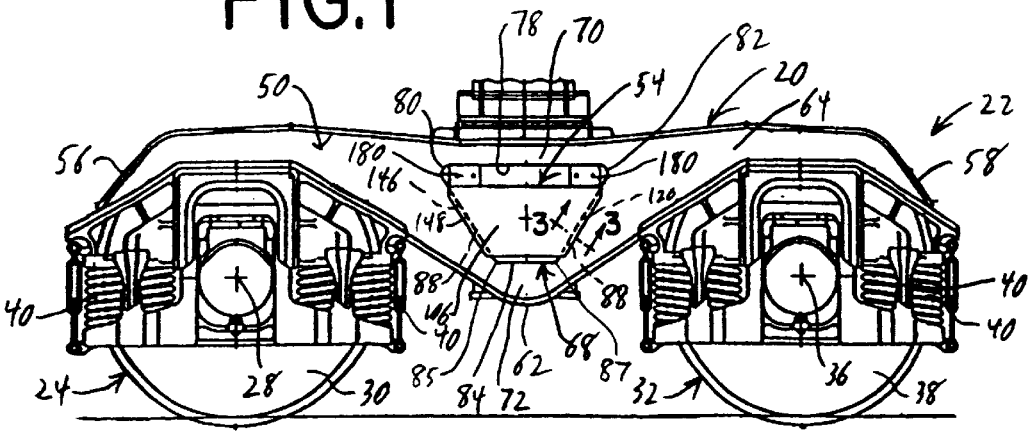
FIG. 1 is a side elevational view of a railway truck including the three-piece railway truck frame of the present invention.
Figure 2:
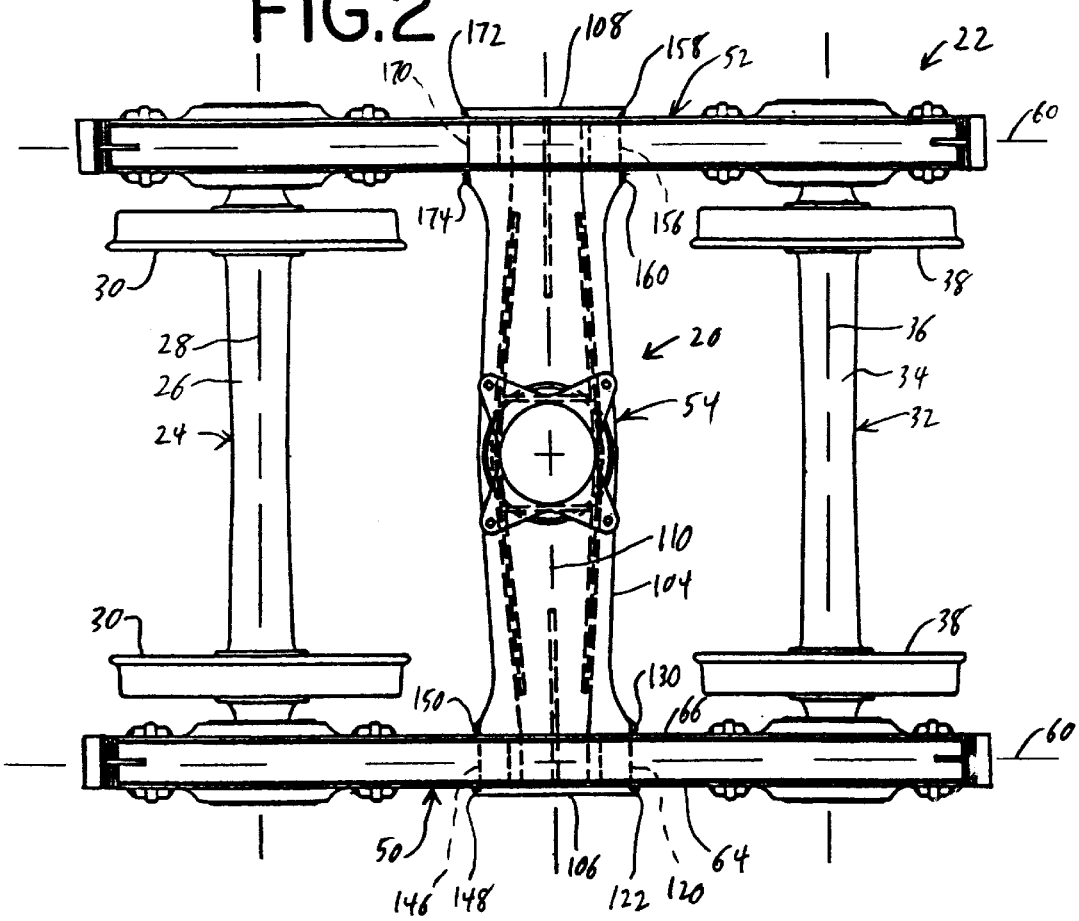
FIG. 2 is a top plan view of the railway truck including the three-piece railway truck frame.

The railway truck frame 20, as shown in FIGS. 1 and 2, is adapted for use as part of a railway truck 22. In addition to the truck frame 20, the railway truck 22 includes a first wheel set 24 including an elongate axle 26 having a central axis 28, and first and second wheels 30. The railway truck 22 also includes a second wheel set 32 including an elongate axle 34 having a central axis 36, and first and second wheels 38. Each end of the axles 26 and 34 is connected to the truck frame 20 by one or more resilient springs 40. The first wheel set 24 is rotatable about the axis 28 with respect to the truck frame 20 and the second wheel set 32 is rotatable about the axle 34 with respect to the truck frame 20.

The railway truck frame 20 includes a first side frame 50 and a second side frame 52 which is spaced apart from and generally parallel to the first side frame 50. The second side frame 52 is constructed substantially identical to the first side frame 50. While the first side frame 50 will be described herein, it is to be understood that the second side frame 52 is constructed in the same manner. Corresponding elements between the first side frame 50 and the second side frame 52 will be indicated with the same reference numbers in the drawing figures. The truck frame 20 also includes a bolster 54. The railway truck frame 20 thereby includes three major pieces, namely the first side frame 50, the second side frame 52, and the bolster 54.

The first side frame 50 extends between a first end 56 and a second end 58 and includes a generally linear central axis 60. Each end 56 and 58 of the first side frame 50 includes a pedestal adapted to receive a bearing and one end of the axle of a wheel set. The first side frame 50 includes a midsection 62 located between the first end 56 and the second end 58. The first side frame 50 includes an external surface 64 and an internal surface 66. The midsection 62 includes a bolster window 68 which extends transversely through the first side frame 50 from the external surface 64 to the internal surface 66. As best shown in FIG. 1, the window 68 is generally formed in the shape of a trapezoid or an inverted truncated isosceles triangle. The window 68 forms a generally horizontal compression member 70 in the first side frame 50 located above the window 68 and a generally horizontal tension member 72 located below the window 68.

Figures 3, 4, 5, 6, 7, 8:
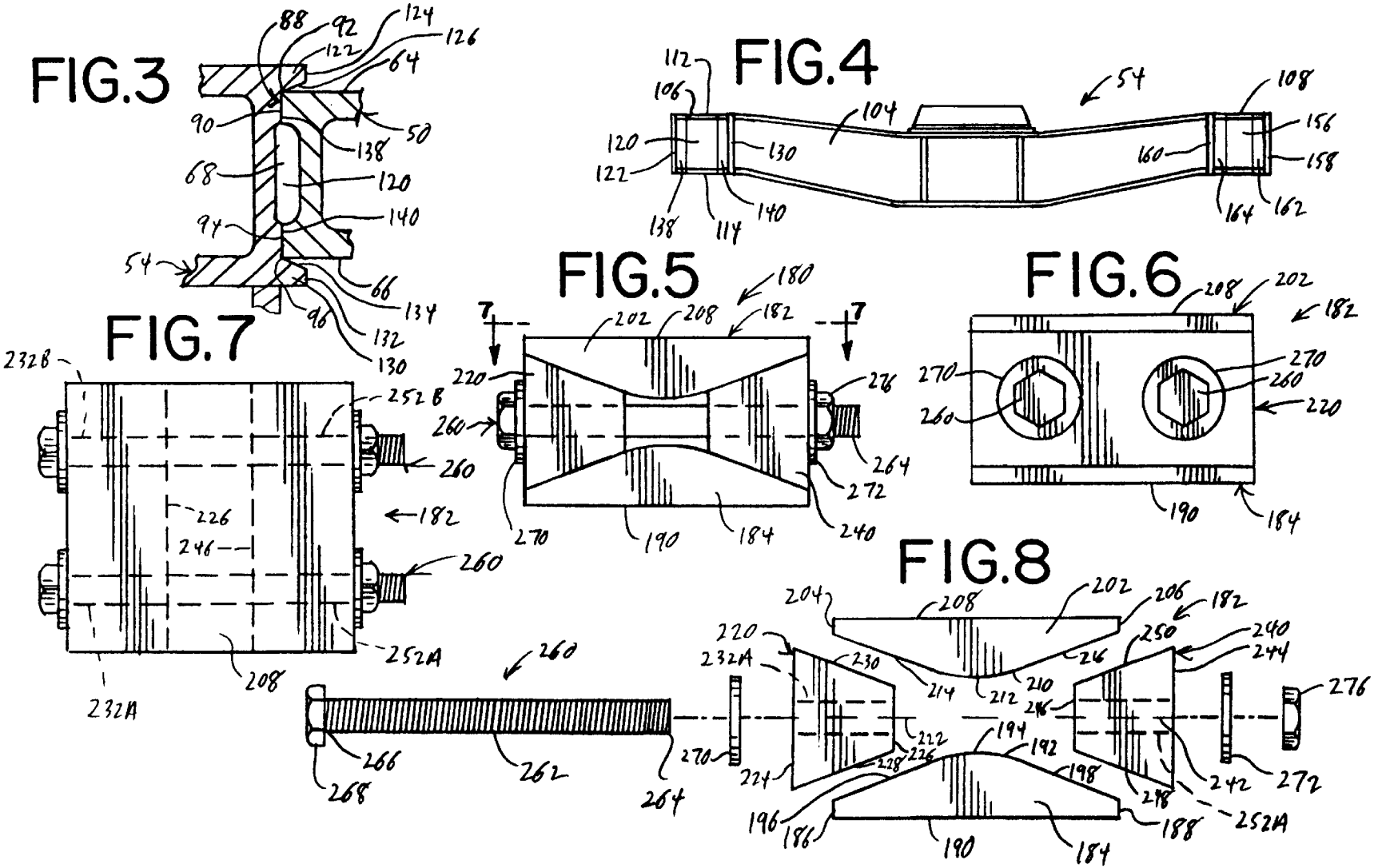
FIG. 3 is a cross sectional view taken along line 3—3 of FIG. 1.
FIG. 4 is a side elevational view of the bolster of the railway truck frame.
FIG. 5 is a side elevational view of the locking device of the railway car truck frame.
FIG. 6 is an end view of the locking device.
FIG. 7 is a top plan view of the locking device taken along line 7—7 of FIG. 5.
FIG. 8 is an exploded view of the locking device.

The bolster window 68 includes a generally horizontal top side 78 extending generally linearly between a first end 80 and a second end 82. The window 68 also includes a generally horizontal bottom side 84 that extends generally linearly between a first end 85 and a second end 87. The bottom side 84 is spaced apart from and generally parallel to the top side 78. The window 68 also includes a first inclined side 86 which extends downwardly and inwardly from the first end 80 of the top side 78 of the window 68 to the first end 85 of the bottom side 84. The window 68 also includes a second inclined side 88 which extends downwardly and inwardly from the second end 82 of the top side 78 to the second end 87 of the bottom side 84. As best shown in FIG. 3, the second inclined side 88 of the window 68 includes a generally planar and elongate first bearing surface 90 which extends along the length of the second inclined side 88 generally perpendicular to the external surface 64. The first bearing surface 90 and the external surface 64 intersect at a generally linear edge 92. The second inclined side 88 also includes a second bearing surface 94 which is generally planar and elongate and which extends along the length of the second inclined side 88. The second bearing surface 94 is generally coplanar with and spaced apart from the first bearing surface 90, and is generally perpendicular to the internal surface 66 of the first side frame 50. The second bearing surface 94 and the internal surface 66 intersect along a generally linear edge 96. If desired the bearing surfaces 90 and 94 could extend entirely between the edges 92 and 96 as a single bearing surface, or the bearing surfaces 90 and 94 may be spaced inwardly from the edges 92 and 96.

The first inclined side 86 of the window 68 is constructed in the same manner as the second inclined side 88. The top side 78 and bottom side 84 of the window 68 may be constructed in the same manner as the first inclined side 86, having two spaced apart generally planar surfaces, or with a single surface extending between the external surface 64 and the internal surface 66 of the side frame 50. As stated above, the second side frame 52 is constructed substantially identical to the first side frame 50 and is located generally parallel to and spaced apart from the first side frame 50. The first side frame 50 and second side frame 52 may each be fabricated or cast from steel as a single integral piece.

The bolster 54, as best shown in FIGS. 2 and 4, includes an elongate body 104 having a first end 106, a second end 108 and a central longitudinal axis 110 extending between the first end 106 and the second end 108. The bolster 54 includes a top side 112 and a bottom side 114. The first end 106 of the bolster 54 includes a first inclined channel 120 that extends between the bottom side 114 and top side 112. The first channel 120 includes an external flange 122 that extends generally linearly between the top side 112 and bottom side 114 of the bolster 54. The external flange 122 includes an outer end 124 and an interior inclined wall 126. The first channel 120 also includes an internal flange 130 which extends generally linearly between the top side 112 and bottom side 114 of the bolster 54 and which is spaced apart from and generally parallel to the external flange 122. The internal flange 130 includes an outer end 132 and an inclined interior wall 134. The first channel 120 also includes a first bearing surface 138 which is generally planar and which extends along and adjacent to the interior wall 126 of the external flange 122. As shown in FIG. 3, the first bearing surface 138 is adapted to engage the first bearing surface 90 of the second inclined side 88 of the window 68 in the first side frame 50. The first channel 120 also includes a second bearing surface 140 which is generally planar and which extends along and adjacent the internal wall 134 of the internal flange 130. The second bearing surface 140 is generally coplanar with the first bearing surface 138 and is spaced apart and generally parallel thereto. The second bearing surface 140 as shown in FIG. 3 is adapted to engage the second bearing surface 94 of the second inclined side 88 of the window 68 in the first side frame 50. The first and second bearing surfaces 138 and 140 are located between the external flange 122 and the internal flange 130, and if desired may extend across the entire distance between the flanges 122 and 130 as a single bearing surface.

As shown in FIG. 3, the external flange 122 and internal flange 130 extend outwardly beyond the bearing surfaces 138 and 140 such that the second inclined side 88 of the first side frame 50 is located closely between the external flange 122 and the internal flange 130. The edge 92 of the first side frame 50 is located at the intersection of the interior wall 126 of the external flange 122 and the first bearing surface 138, and the edge 96 of the first side frame 50 is located at the intersection of the interior wall 134 of the internal flange 130 and the second bearing surface 140. The flanges 122 and 130 thereby prevent movement of the first side frame 50 with respect to the bolster 54 in a direction parallel to the central axis 110 of the bolster 54 and transverse to the central axis 60 of the first side frame 50.

The first end 106 of the bolster 54 includes a second inclined channel 146 that extends between the top side 112 and bottom side 114 of the bolster 54. The second channel 146 is located on the opposite side of the bolster 54 from the first channel 120. The second inclined channel 146 is constructed in the same manner as the first channel 120 and includes an external flange 148 and a spaced apart and generally parallel internal flange 150. The second channel 146 additionally includes a first bearing surface and a second bearing surface which are located between the external flange 148 and internal flange 150 and which are respectively adapted to engage the first and second bearing surfaces of the first inclined side 86 of the window 68 in the first side frame 50. As shown in FIG. 1, the first channel 120 and second channel 146, as well as their respective flanges and bearing surfaces extend downwardly and inwardly from the top side 112 of the bolster 54 to the bottom side 114. As shown in FIG. 1, the first end 106 of the bolster 54, as viewed along the central axis 110, is generally trapezoidal in shape and is adapted to fit within the window 68 of the first side frame 50.

The second end 108 of the bolster 54 is constructed identically to the first end 106. The second end 108 includes a first inclined channel 156 having an external flange 158 and a spaced apart and generally parallel internal flange 160. A generally planar first bearing surface 162 is located adjacent to and extends along the external flange 158 and a generally planar second bearing surface 164 is located adjacent to and extends along the internal flange 160. The bearing surfaces 162 and 164 are located between the flanges 158 and 160 and if desired may join one another to extend completely between the flanges 158 and 160. The second end 108 of the bolster 54 also includes a second inclined channel 170 located on the opposite side from the first channel 156. The second channel 170 includes an external flange 172 and an internal flange 174 spaced apart from and generally parallel to the external flange 172. The second channel 170 includes generally planar first and second bearing surfaces and is constructed substantially identical to the first channel 156. The second end 108 of the bolster 54 is adapted to fit within the window 68 in the second side frame 52. The bolster 54 may be cast or fabricated from steel as a single unitary piece.

The first end 106 of the bolster 54 is inserted horizontally into the window 68 of the first side frame 50 and is lowered downwardly such that the first inclined side 86 of the window 68 is located within the first inclined channel 120 of the bolster 54 between the external flange 122 and internal flange 130 with the bearing surfaces of the first inclined channel 120 engaging the bearing surfaces of the first inclined side 86 of the window 68. and such that the second inclined side 88 of the window 68 is located within the second inclined channel 146 of the bolster 54 between the external flange 148 and internal flange 150 with the bearing surfaces of the second inclined channel 146 engaging the bearing surfaces of the second inclined side 88 of the window 68. The bottom side 114 of the bolster 54 is spaced apart and above the bottom side 84 of the window 68 in the first side frame 50. The external flanges 122 and 148 and the internal flanges 130 and 150 prevent movement of the first side frame 50 in a direction parallel to the central axis 110 of the bolster 54. Vertical forces transmitted from the bolster 54 to the first side frame 50 are transmitted only through the inclined bearing surfaces of the first channel 120 and second channel 146 to the inclined bearing surfaces of the first inclined side 86 and the second inclined side 88 of the window 68 in the first side frame 50. The magnitude of any bending moments created in the bolster 54 or first side frame 50 is thereby reduced enabling the provision of a lighter weight side frame 50 and bolster 54. The second end 108 of the bolster 54 is inserted and located within the window of the second side frame 52 in a similar manner such that the bolster 54 extends transversely between the first side frame 50 and second side frame 52.

The ends 106 and 108 of the bolster 54 may then be rigidly attached or connected to the respective side frames 50 and 52 in one of various different manners. The ends 106 and 108 can be welded to the side frames 50 and 52, however, this permanent type of connection makes removal of the bolster 54 from the side frame 50 or 52 impractical. It is preferred to removably and rigidly connect each end 106 and 108 of the bolster 54 to a respective side frame 50 and 52 with one or more locking devices 180.

Each locking device 180, as shown in FIGS. 5–8, is a mechanical jack 182, although hydraulic or pneumatic jacks may be utilized if desired. The jack 182 includes a first base member 184 having a first end 186 and a second end 188. A generally planar first surface 190 extends between the first end 186 and second end 188. A generally arched second surface 192 having a vertex 194 extends between the first end 186 and second end 188. The first surface 190 is adapted to be located on and engage the top side 112 of the bolster 54. The second surface 192 includes a first inclined surface portion 196 which is generally planar and which is located between the first end 186 and the vertex 194. The second surface 192 includes a generally planar second inclined surface portion 198 located between the second end 188 and the vertex 194. Each of the first and second inclined surface portions 196 and 198 extend outwardly from their respective ends 186 and 188 of the first base member 184 in a direction away from the first surface 190 and both are inclined at the same angle with respect to the first surface 190. If desired, the first base member 184 may be integrally attached to the bolster 54.

The jack 182 also includes a second base member 202 which is constructed identically to the first base member 184. The second base member 202 includes a first end 204 and a second end 206. A generally planar first surface 208 extends between the first end 204 and second end 206. The first surface 208 is adapted to engage the top side 78 of the window 68 of the side frame 50 or 52. The second base member 202 includes a generally arched second surface 210 having a vertex 212 which extends between the first end 204 and the second end 206. The second surface 210 includes a generally planar first inclined surface portion 214 which extends between the first end 204 and the vertex 212, and a generally planar second inclined surface portion 216 which extends between the second end 206 and the vertex 212. As shown in FIGS. 5 and 8 the second base member 202 is inverted with respect to the first base member 184. If desired, the second base member 184 may be integrally attached to a side frame.

The jack 182 also includes a first wedge 220 having a horizontal central axis 222. The first wedge 220 also includes a vertical generally planar outer surface 224 and a spaced apart and generally parallel vertical and planar inner surface 226. The first wedge 220 also includes a generally planar inclined bottom surface 228 which extends inwardly from the outer surface 224 to the inner surface 226 at an angle to the central axis 222. The first wedge 220 also includes an inclined top surface 230 that extends inwardly from the outer surface 224 to the inner surface 226 at the same angle with respect to the central axis 222 as the lower inclined surface 228 is disposed. As shown in FIG. 8, the first wedge 220, as viewed from the side, is formed in the general shape of a trapezoid or a truncated isosceles triangle. The first wedge 220 also includes a pair of spaced apart linear bores 232A–B which extend between the outer surface 224 and inner surface 226 generally parallel to one another and to the central axis 222.

The jack 182 also includes a second wedge 240 which is constructed identically to the first wedge 220. The second wedge 240 includes a horizontal central axis 242. The second wedge 240 includes a vertical generally planar outer surface 244 and a vertical generally planar inner surface 246 that is spaced apart from and generally parallel to the outer surface 244. A generally planar inclined bottom surface 248 extends inwardly from the outer surface 244 to the inner surface 246 at an angle to the central axis 242. A generally planar inclined top surface 250 extends inwardly from the outer surface 244 to the inner surface 246 at an angle to the central axis 242 which is the same as the angle at which the lower inclined surface 248 is disposed with respect to the central axis 242. The second wedge 240 includes a pair of spaced apart linear bores 252A–B which extend between the outer surface 244 and inner surface 246 generally parallel to one another and the central axis 242.

The inclined bottom surface 228 of the first wedge 220 is adapted to be located in coplanar sliding engagement with the first inclined surface portion 196 of the first base member 184 and the inclined top surface 230 of the first wedge 220 is adapted to be located in coplanar sliding engagement with the first inclined surface portion 214 of the second base member 202. Similarly, the inclined bottom surface 248 of the second wedge 240 is adapted to be located in coplanar sliding engagement with the second inclined surface portion 198 of the first base member 184 and the inclined top surface 250 is adapted to be located in coplanar sliding engagement with the second inclined surface portion 216 of the second base member 202. Each of the surfaces 196, 198, 214, 216, 228, 230, 248 and 250 are inclined at the same angle. As shown in FIG. 5, the first surface 208 of the second base member 202 is located generally parallel to the first surface 190 of the first base member 184. The inner surface 226 of the first wedge 220 is spaced apart from the inner surface 246 of the second wedge 240 when the outer surfaces 224 and 244 of the wedges 220 and 240 are respectively located at the ends of the base members 184 and 202 as shown in FIG. 5.

Each jack 182 also includes an actuator that provides selective movement of the wedges 220 and 240 with respect to the base members 184 and 202. As shown in FIGS. 5–8 the actuator may comprise one or more fasteners. The actuator could alternatively comprise a hydraulic or pneumatic cylinder. Each fastener includes a bolt 260 and a nut 276. Each bolt 260 includes a threaded shaft 262 having a first end 264 and a second end 266. A hexagonal head 268 is attached to the second end 266 of the shaft 262. The first end 264 of the bolt 260 is inserted through a washer 270, through the bore 232A in the first wedge 220, through the bore 252A in the second wedge 240, and through a washer 272. The nut 276 is threadably attached to the first end 264 of the bolt 260. If desired the washer 272 may be locking washer or a second nut (not shown) may be threadably attached to the first end 264 of the bolt 260 to lock the nut 276 in place and to prevent inadvertent loosening of the nut 276. The second bolt 260 is similarly inserted through a washer 270, the bore 232B of the first wedge 220, the bore 252B of the second wedge 240, and a washer 272. A second nut 276 is threadably attached to the first end of the second bolt 260.

Other types of locking devices 180 may be used if desired, such as various types of fasteners. Each end 106 and 108 of the bolster 54 can be directly connected by fasteners such as bolts or pins to a respective side frame 50 or 52 such that upon removal of the fasteners the bolster 54 can be removed from the side frames.

In operation, after the ends 106 and 108 of the bolster 54 have respectively been located and seated within the window 68 of the first and second side frames 50 and 52, one or more locking devices 180 are placed within the window 68 of the first side frame 50 such that the locking device 180 is located between the top side 112 of the bolster 54 and the top side 78 of the window 68. If desired, the locking devices 180 may be placed in the top corners between the side frame and the bolster 54. The nuts 276 on the bolts 260 are tightened such that the first wedge 220 and second wedge 240 are drawn toward one another and are slid along the inclined surfaces 196, 198, 214 and 216 of the base members 184 and 202 toward the vertices 194 and 212. The wedges 220 and 240 thereby force the first and second base members 184 and 202 apart from one another in a vertical direction perpendicular to the central axes 222 and 242, and thereby increase the distance with which the upper surface 208 of the second base member 202 is separated and spaced apart from the first surface 190 of the first base member 184. The first surface 190 of the first base member 184 engages the top side 112 of the first end 56 of the bolster 54 and the first surface 208 of the second base member 202 engages the top side 78 of the window 68 of the first side frame 50.

As the first and second base members 184 and 202 are forced apart from one another by the wedges 220 and 240, the jack 182 locks the first and second inclined sides 86 and 88 of the window 68 of the first side frame 50 within the first channel 120 and second channel 146 of the first end 56 of the bolster 54 in engagement with the bearing surfaces of the first and second channels 120 and 146 and thereby rigidly connects the first end 56 of the bolster 54 to the first side frame 50. The nuts 276 may be selectively loosened from the bolts 260 such that the wedges 220 and 240 may be withdrawn, or moved apart from one another, such that the base members 184 and 202 move closer together and eventually disengage from the top side 78 of the window 68. The jacks 182 may then be removed from the window 68 such that the first end 56 of the bolster 54 may be lifted from the inclined sides 86 and 88 of the window 68 and removed from the window 68 to enable the repair and/or replacement of the bolster 54 or first side frame 50. One or more locking devices 180 are also used to releasably rigidly connect the second end 58 of the bolster 54 to the second side frame 52 in the same manner.

If desired, the second base member 202 could be eliminated from the jack 182, and the inclined top surface 230 of the first wedge 220 and the inclined top surface 250 of the second edge 240 could be located generally parallel to the first surface 190 of the base member 184. In addition, the second wedge 240 could be eliminated if desired such that the fastener directly couples the first wedge 220 to a base member 184 or 202 to provide movement of the first wedge 220 with respect to the base members.

Various features of the invention have been particularly shown and described in connection with the illustrated embodiment of the invention. However, it must be understood that these particular arrangements merely illustrate, and that the invention is to be given its fullest interpretation within the terms of the appended claims.

What is claimed is:

1. A railway truck frame for a railway truck including:

a first side frame having a compression member, a tension member, and a window extending through said first side frame located between said compression member and said tension member, said window including an inclined first side extending downwardly and inwardly away from said compression member and toward said tension member and a second side;

a bolster having a top side, a bottom side, a first end, a second end and a central longitudinal axis extending from said first end to said second end, said first end of said bolster including a first external flange, a first internal flange spaced apart from said first external flange, and an inclined first bearing surface located between said first external flange and said first internal flange, said inclined first bearing surface extending downwardly and inwardly away from said top side and toward said bottom side of said bolster, said first end of said bolster adapted to be located in said window of said first side frame such that said first side of said window is located between said first internal flange and said first external flange of said first end of said bolster and such that said inclined first side of said window engages said inclined first bearing surface of said bolster and thereby supports said first end of said bolster; and wherein, said window and a portion of said bolster located in said window have generally trapezoidal shapes.

2. The railway truck frame of claim 1 including locking means for selectively rigidly connecting said first end of said bolster to said first side frame.

3. The railway truck frame of claim 1 including a locking device having a first end and a second end, said first end of said locking device being selectively movable with respect to said second end of said locking device, said locking device adapted to be located within said window such that said first end of said locking device engages said first side frame and said second end of said locking device engages said bolster, said locking device adapted to selectively force said bolster into engagement with said first side of said window of said first side frame to thereby connect said first end of said bolster to said first side frame, said locking device being adapted to selectively release said first end of said bolster from said first side frame such that said first end of said bolster can be selectively removed from said window of said first side frame.

4. The railway truck frame of claim 3 wherein said locking device includes a first base member, a second base member and a wedge located between said first base member and said second base member, said first base member including said first end of said locking device and said second base member including said second end of said locking device.

5. The railway truck frame of claim 4 wherein said locking device includes a second wedge located between said first base member and said second base member, and an actuator connecting said first wedge to said second wedge, said actuator adapted to selectively draw said first and second wedges toward one another and thereby force said first base member away from said second base member.

6. The railway truck frame of claim 1 wherein said first internal flange is adapted to engage an interior portion of said first side frame and said first external flange is adapted to engage an exterior portion of said first side frame.

7. The railway truck frame of claim 1 wherein said first side of said window includes an inclined bearing surface adapted to engage and support said first bearing surface of said bolster.

8. The railway truck frame of claim 1 wherein said first end of said bolster includes a second external flange and a second internal flange spaced apart from said second external flange, said first end of said bolster adapted to be located in said window of said first side frame such that said second side of said window is located between said second internal flange and said second external flange of said first end of said bolster.

9. The railway truck frame of claim 8 wherein said first end of said bolster includes an inclined second bearing surface located between said second external flange and said second internal flange, said second side of said window adapted to engage said second bearing surface and thereby support said first end of said bolster.

10. The railway truck frame of claim 8 wherein said first external flange and said second external flange are located in a generally V-shaped arrangement with respect to one another, said V-shaped arrangement being disposed generally perpendicular to said longitudinal axis of said bolster.

11. The railway truck frame of claim 10 wherein said first internal flange is located generally parallel to said first external flange, and said second internal flange is located generally parallel to said second external flange.

12. The railway truck frame of claim 1 wherein said second side of said window is inclined such that said first and second sides of said window are located in a generally V-shaped arrangement with respect to one another, said first and second sides of said window extending downwardly and inwardly away from said compression member and toward said tension member.

13. The railway truck frame of claim 12 wherein said window includes a bottom side extending between said first and second sides of said window.

14. The railway truck frame of claim 1 including a second side frame having a window extending through said second side frame, said window of said second side frame including a first side and a second side, and said second end of said bolster includes a second internal flange and a second external flange, said second end of said bolster adapted to be located in said window of said second side frame such that said first side of said window of said second side frame is located between said second internal flange and said second external flange of said second end of said bolster.

* * * * *